US009518754B2

(12) United States Patent
Wakamoto et al.

(10) Patent No.: US 9,518,754 B2
(45) Date of Patent: Dec. 13, 2016

(54) AIR-CONDITIONING APPARATUS

(75) Inventors: Shinichi Wakamoto, Chiyoda-ku (JP); Naofumi Takenaka, Chiyoda-ku (JP); Koji Yamashita, Chiyoda-ku (JP); Osamu Morimoto, Chiyoda-ku (JP); Hirofumi Koge, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 360 days.

(21) Appl. No.: 14/354,668

(22) PCT Filed: Jan. 24, 2012

(86) PCT No.: PCT/JP2012/000409

§ 371 (c)(1),
(2), (4) Date: Apr. 28, 2014

(87) PCT Pub. No.: WO2013/111177

PCT Pub. Date: Aug. 1, 2013

(65) Prior Publication Data

US 2014/0245766 A1 Sep. 4, 2014

(51) Int. Cl.

| | |
|---|---|
| ***F24F 11/00*** | (2006.01) |
| ***F25B 13/00*** | (2006.01) |
| ***F25B 47/02*** | (2006.01) |

(52) U.S. Cl.

CPC ..... *F24F 11/0086* (2013.01); *F25B 13/00* (2013.01); *F25B 47/022* (2013.01);
(Continued)

(58) Field of Classification Search

CPC ..... F25B 7/022; F25B 13/00; F25B 2313/005; F25B 2313/006; F25B 2313/02322; F25B 2313/0233; F25B 2313/02741; F25B 2400/13; F25B 2600/2501; F25B 2313/0253
(Continued)

(56) References Cited

U.S. PATENT DOCUMENTS 5,575,158 A * 11/1996 Vogel ..... F25B 47/022 62/156
5,755,104 A * 5/1998 Rafalovich ..... F25B 13/00 62/205
(Continued)

FOREIGN PATENT DOCUMENTS

| | | |
|---|---|---|
| JP | 57-108558 | 7/1982 |
| JP | 60 116163 | 8/1985 |

(Continued)

OTHER PUBLICATIONS

Translation of JP 2008-249236 to Takeshi et al having pulication date Oct. 16, 2008.*
(Continued)

*Primary Examiner* — Mohammad M Ali
(74) *Attorney, Agent, or Firm* — Oblon, McClelland, Maier & Neustadt, L.L.P.

(57) ABSTRACT

A first flow switching device causes part of a refrigerant discharged from an injection compressor to flow through a first bypass pipe and be supplied to an outdoor heat exchanger targeting for defrosting. A second flow switching device causes part of the refrigerant supplied to the outdoor heat exchanger targeting for defrosting to enter a second bypass pipe.

14 Claims, 10 Drawing Sheets

(52) U.S. Cl.
CPC ..... *F24F 2011/0087* (2013.01); *F24F 2011/0089* (2013.01); *F25B 2313/005* (2013.01); *F25B 2313/006* (2013.01); *F25B 2313/0233* (2013.01); *F25B 2313/0253* (2013.01); *F25B 2313/02322* (2013.01); *F25B 2313/02741* (2013.01); *F25B 2400/13* (2013.01); *F25B 2600/2501* (2013.01)

(58) Field of Classification Search
USPC ..... 62/151
See application file for complete search history.

(56) References Cited

U.S. PATENT DOCUMENTS

| | | | | |
|---|---|---|---|---|
| 7,716,941 | B2 * | 5/2010 | Park | F25B 13/00 62/277 |
| 9,303,881 | B2 * | 4/2016 | Wakashima | F24F 1/06 |
| 2006/0213215 | A1 * | 9/2006 | Hirano | F25B 47/022 62/352 |
| 2007/0074523 | A1 * | 4/2007 | Takegami | F25B 13/00 62/151 |
| 2007/0130967 | A1 * | 6/2007 | Park | F25B 13/00 62/151 |
| 2009/0013714 | A1 * | 1/2009 | Yamaguchi | F04C 18/02 62/510 |
| 2009/0031737 | A1 * | 2/2009 | Ueno | F25B 13/00 62/151 |
| 2009/0282848 | A1 * | 11/2009 | Takegami | F25B 13/00 62/222 |
| 2011/0088421 | A1 * | 4/2011 | Wakamoto | F25B 13/00 62/238.7 |
| 2011/0138839 | A1 * | 6/2011 | Lee | F25B 13/00 62/324.5 |
| 2011/0289952 | A1 * | 12/2011 | Kim | F24D 11/0214 62/189 |

FOREIGN PATENT DOCUMENTS

| | | | |
|---|---|---|---|
| JP | 61 235644 | | 10/1986 |
| JP | 6 241623 | | 9/1994 |
| JP | 2000-18734 | | 1/2000 |
| JP | 2004-183913 | A | 7/2004 |
| JP | 2006-145144 | A | 6/2006 |
| JP | 2006 322586 | | 11/2006 |
| JP | 2007-503571 | A | 2/2007 |
| JP | 2007 225271 | | 9/2007 |
| JP | 2007-263443 | A | 10/2007 |
| JP | 2008 249236 | | 10/2008 |
| JP | 2009-79863 | A | 4/2009 |
| JP | 2009 85484 | | 4/2009 |
| JP | 2009-127939 | A | 6/2009 |
| JP | 2010 271011 | | 12/2010 |
| JP | 2011 99572 | | 5/2011 |
| WO | WO 2011/135616 | A1 | 11/2011 |

OTHER PUBLICATIONS

International Search Report Issued Apr. 24, 2012 in PCT/JP12/000409 Filed Jan. 24, 2012.
Office Action issued Mar. 17, 2015 in Japanese Patent Application No. 2013-554983 (with English translation).
Office Action and Search Report issued on Aug. 3, 2015 in the corresponding Chinese Patent Application No. 201280063211.9 (with English Translation).
Extended Search Report issued Sep. 7, 2015 in European Patent Application No. 12866723.5.
Office Action issued Oct. 27, 2015 in Japanese Patent Application No. 2013-554983 (with English language translation).
Office Action mailed Oct. 4, 2016 in Japanese Patent Application No. 2013-554983 (with English Translation).
Office Action issued Oct. 18, 2016 in Japanese Patent Application No. 2016-009098 (with English language translation).

* cited by examiner

AIR-CONDITIONING APPARATUS

TECHNICAL FIELD

The present invention relates to an air-conditioning apparatus.

BACKGROUND ART

Conventional air-conditioning apparatuses perform defrosting operation by inverting a refrigerant cycle to remove frost in an outdoor heat exchanger acting as an evaporator in a heating operation. However, in that defrosting operation, indoor comfort decreases because heating is halted in the defrosting operation. One example of a technique capable of performing a heating operation and a defrosting operation at a time is a heat pump including an outdoor heat exchanger divided into a plurality of parallel heat exchangers, a bypass that bypasses gas discharged from an injection compressor for each of the divided heat exchangers, and an electromagnetic on-off valve that controls a bypass state (see, for example, Patent Literature 1).

That heat pump includes an outdoor unit, indoor units, and a main pipe connecting them such that a refrigerant circulates therethrough and is a multi-type air-conditioning apparatus in which two indoor units are connected to one outdoor unit. The outdoor unit includes an injection compressor, a four-way valve for switching between a cooling operation and a heating operation, outdoor heat exchangers connected in parallel, a first bypass pipes having a first end connected between the injection compressor and the four-way valve and a second end split and connected in parallel to the pipes connected to the outdoor heat exchangers, a second flow switching device for switching the flow of the refrigerant to either one of the main pipe and the first bypass pipe, and a third flow control valve for controlling the flow rate of the refrigerant flowing in the first bypass pipe. That enables continuous heating without inverting the refrigeration cycle by causing part of the refrigerant from the injection compressor to alternately enter each of the bypasses and by alternately defrosting each of the parallel heat exchangers.

There is a refrigeration machine that includes a plurality of parallel heat exchangers, a plurality of main compressors, and a sub compressor and that injects a refrigerant used in deicing for the heat exchanger into the sub compressor (see, for example, Patent Literature 2).

CITATION LIST

Patent Literature

Patent Literature 1: Japanese Unexamined Patent Application Publication No. 2009-85484 (Abstract)

Patent Literature 2: Japanese Unexamined Patent Application Publication No. 2007-225271

SUMMARY OF INVENTION

Technical Problem

However, in the technique in Patent Literature 1, during simultaneous operation of heating operation and defrosting operation, a refrigerant in two-phase gas-liquid state exiting the outdoor heat exchanger targeting for defrosting and a gas refrigerant exiting the outdoor heat exchanger performing heating action are mixed, and the mixture is sucked into the injection compressor. Accordingly, the injection compressor needs to raise not only the pressure of the refrigerant for heating but also that for defrosting from low to high, and thus the efficiency of the air-conditioning apparatus decreases.

Enthalpy usable in defrosting is only sensible heat of the gas, and it is necessary to make a large amount of a high-temperature and high-pressure refrigerant discharged from the injection compressor flow into the first bypass pipes in order to melt frost. That reduces the flow rate of the refrigerant flowing through the outdoor heat exchanger transferring heat to outside the room to perform heating, and thus the heating capacity decreases.

The technique in Patent Literature 2 needs the sub compressor, and is a technique relating to a refrigeration machine capable of performing only refrigeration and freezing, and does not include means for switching the direction of the flow of the refrigerant. Thus it cannot perform heating and cooling required as an air-conditioning apparatus.

The present invention is made to solve the above-described conventional problems. It is an object of the present invention to provide an air-conditioning apparatus capable of improving its energy efficiency and improving its heating capacity during simultaneous operation of heating operation and defrosting operation using a main compressor.

Solution to Problem

An air-conditioning apparatus according to the present invention includes a main pipe that connects indoor units and an outdoor unit such that a refrigerant circulates therethrough. The air-conditioning apparatus further includes an indoor heat exchanger, a flow control valve, an injection compressor, a refrigerant flow switching device, a plurality of outdoor heat exchangers connected in parallel, a first bypass pipe, a second bypass pipe, a first flow switching device, and a second flow switching device. The flow control valve is configured to control a flow rate of the refrigerant entering the indoor heat exchanger. The injection compressor includes an injection port allowing the refrigerant to be injected therethrough into the refrigerant undergoing compression. The refrigerant flow switching device is configured to switch between a cooling operation and a heating operation. The plurality of outdoor heat exchangers are connected in parallel. The first bypass pipe has a first end connected between the injection compressor and the refrigerant flow switching device and a second end connected to a first one of inlet and outlet sides of the plurality of outdoor heat exchangers. The second bypass pipe has a first end connected to the injection port or a pipe connected to the injection port and a second end connected to a second one of the inlet and outlet sides of the plurality of outdoor heat exchangers. The first flow switching device is configured to switch a flow of the refrigerant to the main pipe or the first bypass pipe. The second flow switching device is configured to switch the flow of the refrigerant to the main pipe or the second bypass pipe. In a defrosting operation of removing frost in any of the plurality of outdoor heat exchangers, the first flow switching device causes part of the refrigerant discharged from the injection compressor to flow through the first bypass pipe, and the refrigerant is supplied to the outdoor heat exchanger including the plurality of outdoor heat exchangers, and targeting for defrosting, and the second flow switching device causes part of the refrigerant supplied to the outdoor heat exchanger targeting for defrosting to enter the second bypass pipe.

Advantageous Effects of Invention

According to the present invention, there is no need to lower the pressure of the refrigerant for defrosting to a suction pressure. Accordingly, the injection compressor needs to raise only the pressure of the refrigerant circulating through the main circuit to perform heating from low to high, and needs to raise the pressure of the injected intermediate-pressure two-phase gas-liquid refrigerant only from intermediate to high. Thus, the advantageous effects of reducing the workload of the injection compressor 1 and improving the efficiency of the heat pump and the heating capacity are obtainable.

DESCRIPTION OF EMBODIMENTS

Embodiment 1

Figure 1:
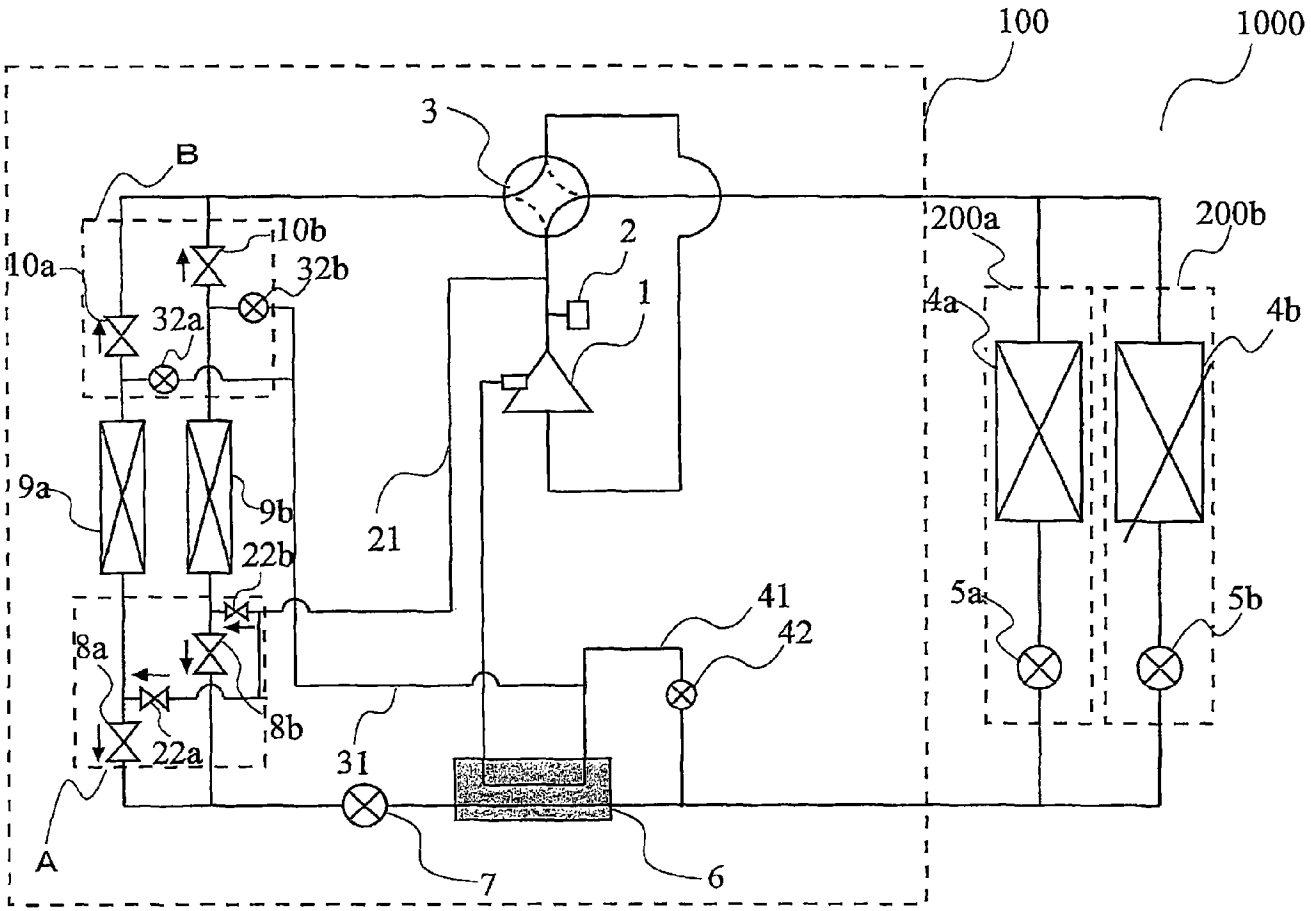
FIG. 1 illustrates a refrigerant circuit in an air-conditioning apparatus according to Embodiment 1 of the present invention.

Embodiment 1 of the present invention is described below with reference to FIGS. 1 to 9. The same reference numerals are used in the same parts. FIG. 1 illustrates a refrigerant circuit in an air-conditioning apparatus according to Embodiment 1 of the present invention. An air-conditioning apparatus 1000 is described below with reference to FIG. 1.

The air-conditioning apparatus 1000 includes an outdoor unit 100, indoor units 200*a* and 200*b*, and a main pipe connecting them such that a refrigerant circulates therethrough. The air-conditioning apparatus 1000 is a multi-type air-conditioning apparatus in which two indoor units are connected to one outdoor unit.

The outdoor unit 100 includes an injection compressor 1, a temperature sensor 2, a four-way valve 3, a refrigerant heat exchanger 6, a second flow control valve 7 (corresponding to an outdoor flow control valve in the present invention), two-way valves 8*a* and 8*b*, outdoor heat exchangers 9*a* and 9*b*, two-way valves 10*a* and 10*b*, a first bypass pipe 21, two-way valves 22*a* and 22*b*, a second bypass pipe 31, third flow control valves 32*a* and 32*b* (corresponding to a second bypass flow control valve in the present invention), a third bypass pipe 41, a fourth flow control valve 42 (corresponding to an injection flow control valve in the present invention), a first flow switching device A, and a second flow switching device B. The indoor unit 200*a* includes an indoor heat exchanger 4*a* and a first flow control valve 5*a* (corresponding to a flow control valve in the present invention). The indoor unit 200*b* includes an indoor heat exchanger 4*b* and a first flow control valve 5*b* (corresponding to the flow control valve in the present invention).

The injection compressor 1 is a compressor capable of injecting a refrigerant into a refrigerant undergoing compression. The temperature sensor 2 measures the temperature of a refrigerant discharged from the injection compressor 1. The four-way valve 3 switches between a cooling operation and a heating operation and corresponds to a refrigerant flow switching device in the present invention. The refrigerant heat exchanger 6 exchanges heat between a refrigerant flowing in the main pipe and a refrigerant flowing in the third bypass pipe 41 (described below).

The first bypass pipe 21 has a first end connected between the injection compressor 1 and the four-way valve 3 and a second end split and connected in parallel to the pipes connected to the outdoor heat exchangers 9*a* and 9*b*. The second bypass pipe 31 has a first end connected to the third bypass pipe 41 and a second end connected in parallel to the pipe different from the pipes connected to the first bypass pipe 21 for the two outdoor heat exchangers 9*a* and 9*b*. The third bypass pipe 41 has a first end connected between the outdoor heat exchangers 9*a* and 9*b* and the main pipe connected to the indoor units 200*a* and 200*b* and a second end connected to an injection port of the injection compressor 1.

The first flow control valves 5*a* and 5*b* control the flow rate of the refrigerant flowing through the indoor units 200*a* and 200*b*. The second flow control valve 7 controls the flow rate of the refrigerant flowing between the refrigerant heat exchanger 6 and the two-way valves 8*a* and 8*b*. The third flow control valves 32*a* and 32*b* control the flow rate of the refrigerant flowing from the second flow switching device B to the second bypass pipe 31. The fourth flow control valve 42 adjusts the flow rate of the refrigerant flowing in the third bypass pipe 41.

The first flow switching device A is made up of the two-way valves 8*a*, 8*b*, 22*a*, and 22*b*. The second flow switching device B is made up of the two-way valves 10*a* and 10*b* and the third flow control valves 32*a* and 32*b*. Each of the two-way valves 8*a*, 8*b*, 10*a*, 10*b*, 22*a*, and 22*b* is openable and closable independently of the magnitude of a pressure at each of an inlet and an outlet of the valve and switches the flow of the refrigerant.

Figure 5:
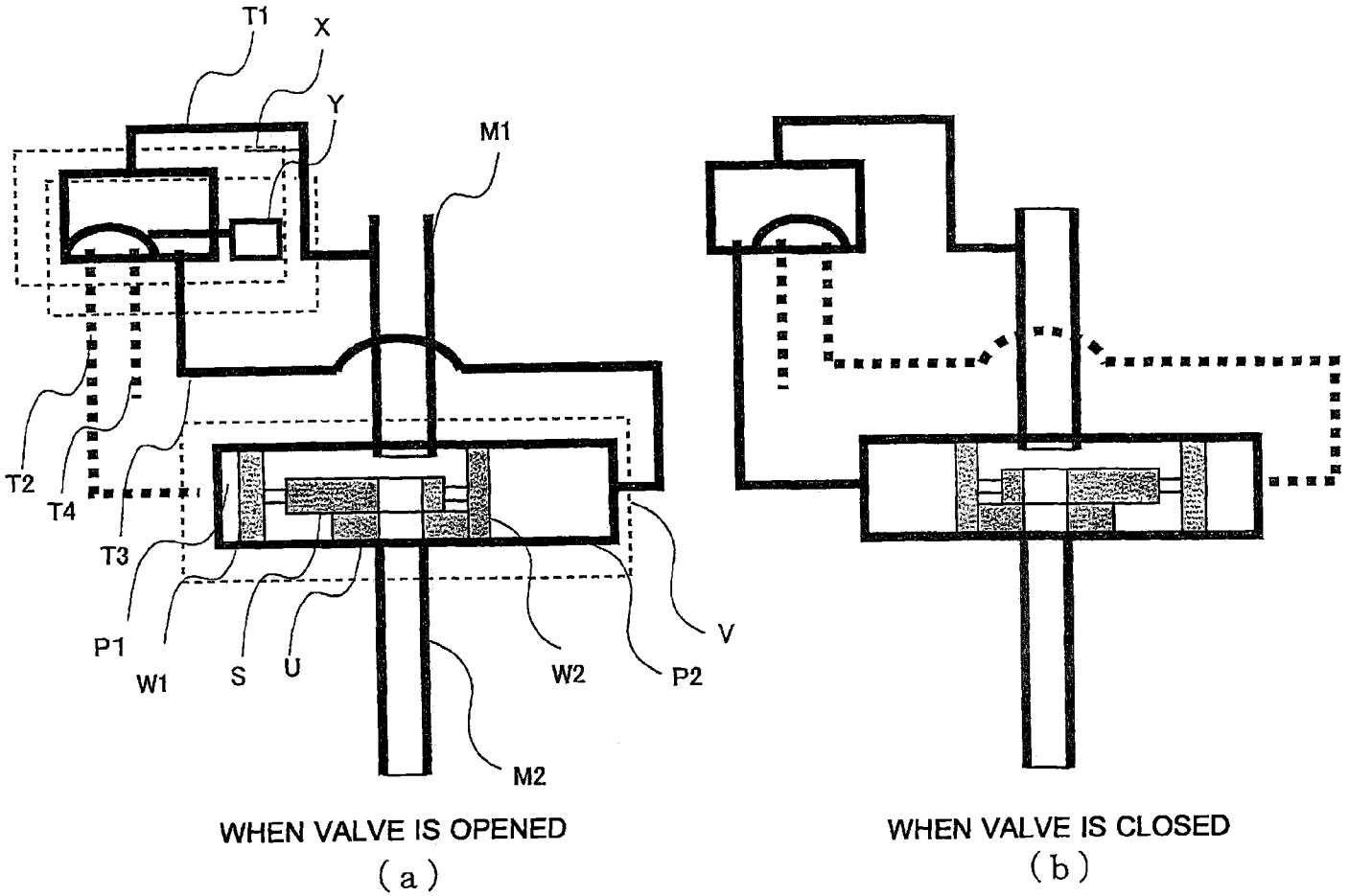
FIG. 5 illustrates a structure and actions of a two-way valve included in the air-conditioning apparatus according to Embodiment 1 of the present invention.

FIG. 5 illustrates one example of a structure of each of the two-way valves 8*a*, 8*b*, 10*a*, 10*b*, 22*a*, and 22*b* and actions. That two-way valve structure is the one in which the valve is openable and closable independently of the magnitude of a pressure at each of an inlet and an outlet of the valve and the valve can stop the refrigerant in only one direction. That two-way valve includes a valve body V to which a main pipe M1 and a main pipe M2 are connected, a pressure adjusting device X for adjusting the pressure in each of pressure chambers P1 and P2 in the valve body V, and pipes T1, T2, T3, and T4 connected to the valve body V and the pressure adjusting device X or the refrigerant pipe.

The valve body V includes movable walls W1 and W2 moving rightward or leftward in accordance with the pressure in each of the pressure chambers P1 and P2 and a small slide valve S. The small slide valve S is attached to the movable walls W1 and W2, moves rightward or leftward on a valve seat U, and opens and closes the valve. The pressure adjusting device X includes the small slide valve S and a small slide valve driving device Y driving the small slide valve S. The small slide valve S is used to selectively switch to either one of the case where the pipes T1 and T3 are connected and the pipes T2 and T4 are connected (valve is opened) and the case where the pipes T1 and T2 are connected and the pipes T3 and T4 are connected (valve is closed).

The pipe T1 is attached to the pressure adjusting device X at a first end and to the main pipe M1 at a second end. The pipe T2 is attached to the pressure adjusting device X at a first end and to the pressure chamber P1 at a second end. The pipe T3 is attached to the pressure adjusting device X at a first end and to the pressure chamber P2 at a second end. The pipe T4 is connected to a location where the pressure is always low in the air-conditioning apparatus, for example, to a low-pressure pipe, a suction pipe of the injection compressor 1, or an accumulator.

In the two-way valve with the above-described structure, when the small slide valve driving device Y moves the small slide valve S leftward, as illustrated in FIG. 5(*a*), the pipe T1 and the pipe T3 are connected and the pipe T2 and the pipe T4 are connected. With this, the pressure in the pressure chamber P1 becomes smaller than the pressure in the pressure chamber P2, the small slide valve S moves leftward, and the valve is opened.

When the small slide valve driving device Y moves the small slide valve S rightward, as illustrated in FIG. 5(*b*), the pipe T1 and the pipe T2 are connected and the pipe T3 and the pipe T4 are connected. With this, the pressure in the pressure chamber P1 becomes larger than the pressure in the pressure chamber P2, the small slide valve S moves rightward, and the valve is closed.

In Embodiment 1, as illustrated in FIG. 1, the two-way valves 10*a* and 10*b* stop the refrigerant in only the direction from the outdoor heat exchangers 9*a* and 9*b* toward the four-way valve 3 (upward in FIG. 1), and the two-way valves 8*a* and 8*b* stop the refrigerant in only the direction from the outdoor heat exchangers 9*a* and 9*b* toward outside the outdoor unit 100 through the main pipe (downward in FIG. 1). The arrow on the side of each of the valves in FIG. 1 indicates the direction of the refrigerant that the valve can stop.

Figure 2:
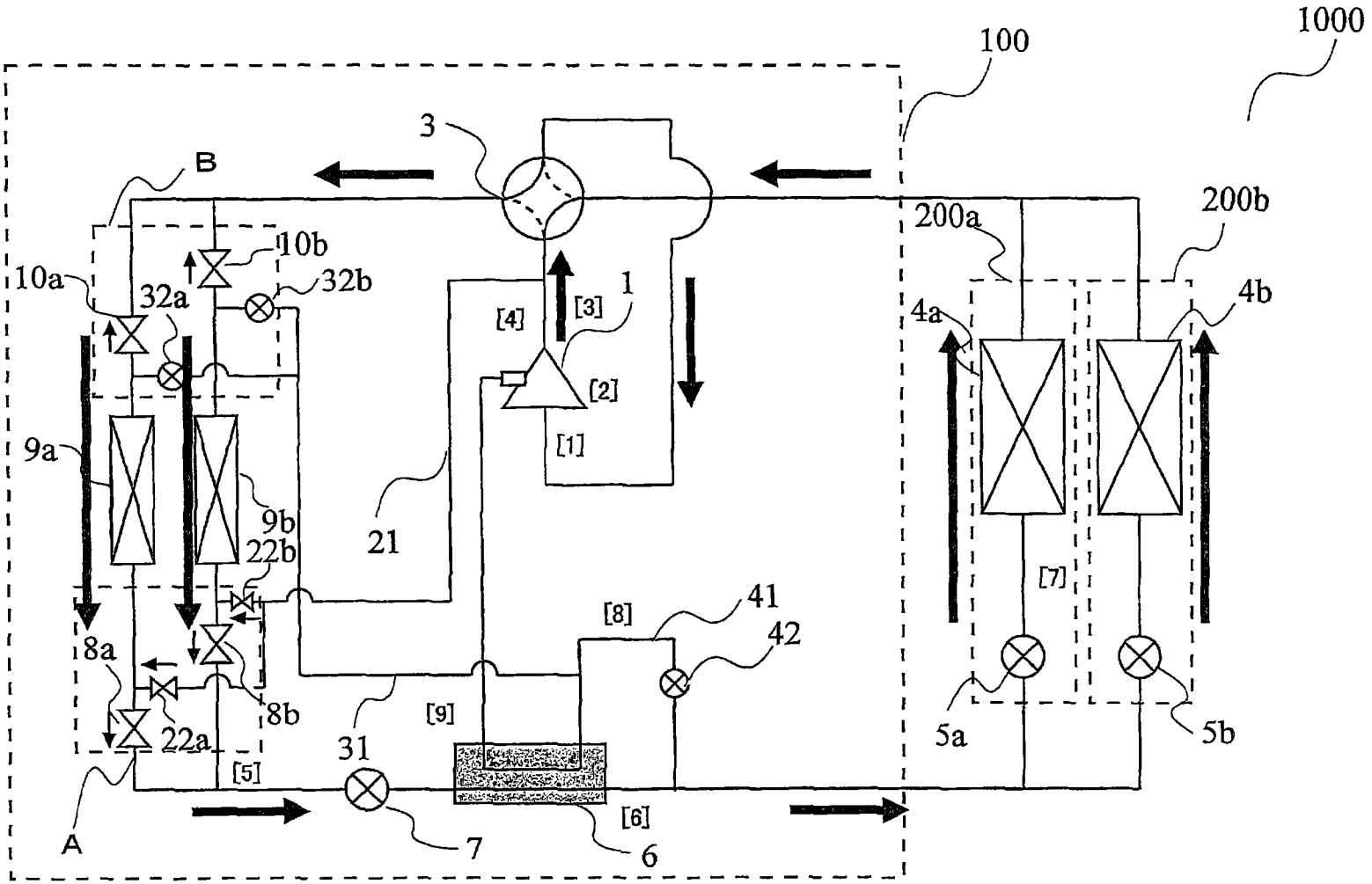
FIG. 2 illustrates a refrigerant flow in a cooling only operation in the air-conditioning apparatus according to Embodiment 1 of the present invention.
Figure 3:
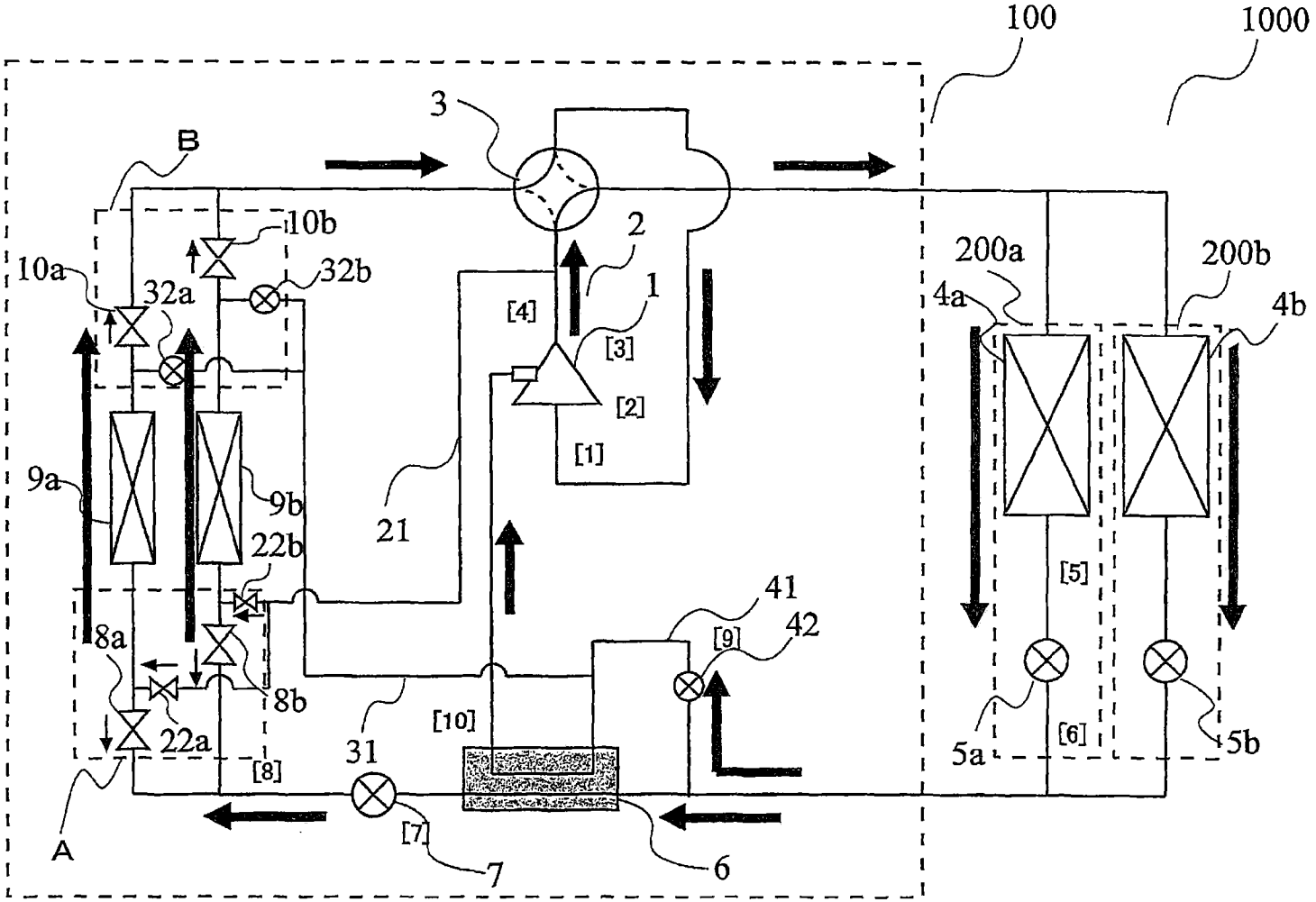
FIG. 3 illustrates a refrigerant flow in a heating only operation in the air-conditioning apparatus according to Embodiment 1 of the present invention.
Figure 4:
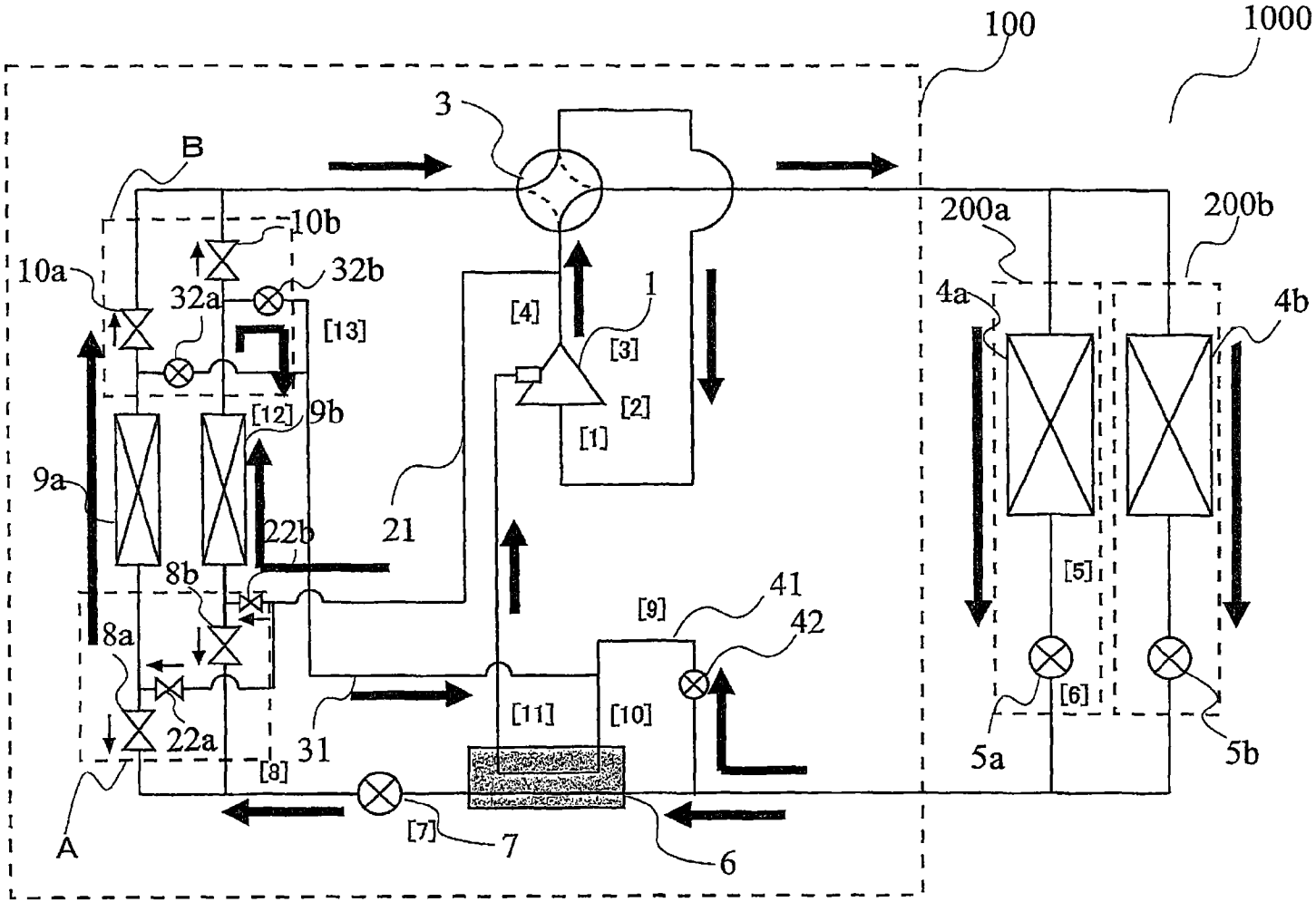
FIG. 4 illustrates a refrigerant flow in a heating and defrosting simultaneous operation in the air-conditioning apparatus according to Embodiment 1 of the present invention.
Figure 7:
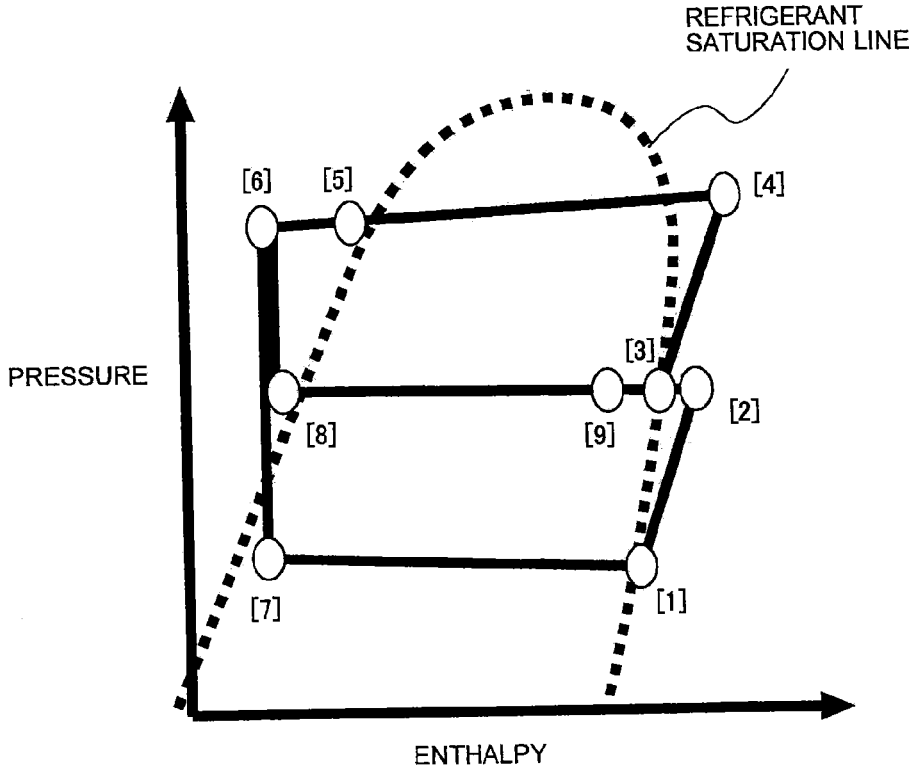
FIG. 7 illustrates a relationship between the pressure of the refrigerant and the enthalpy in the cooling only operation in the air-conditioning apparatus according to Embodiment 1 of the present invention.
Figure 8:
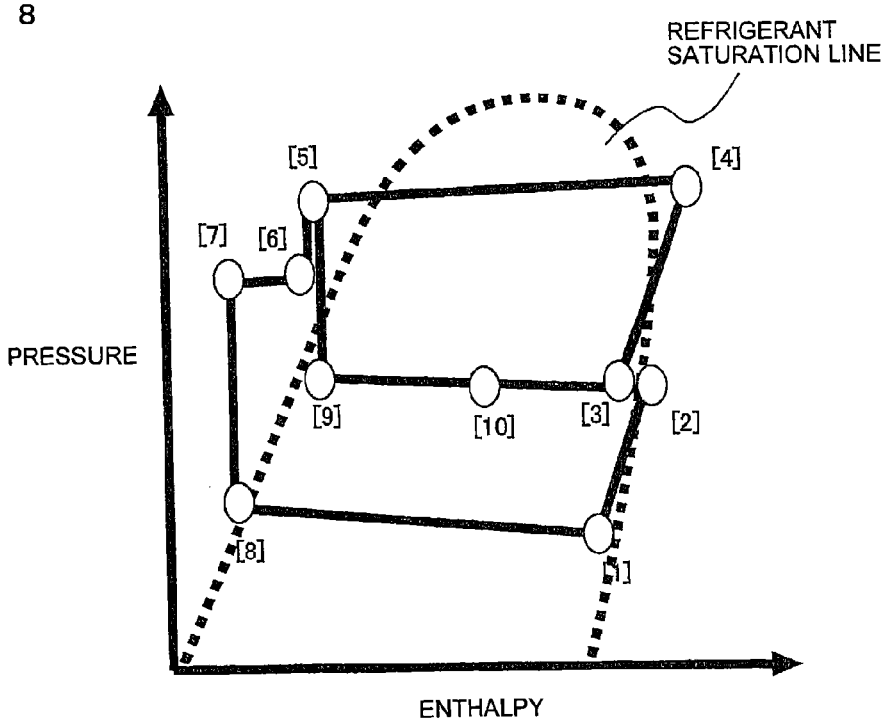
FIG. 8 illustrates a relationship between the pressure of the refrigerant and the enthalpy in the heating only operation in the air-conditioning apparatus according to Embodiment 1 of the present invention.
Figure 9:
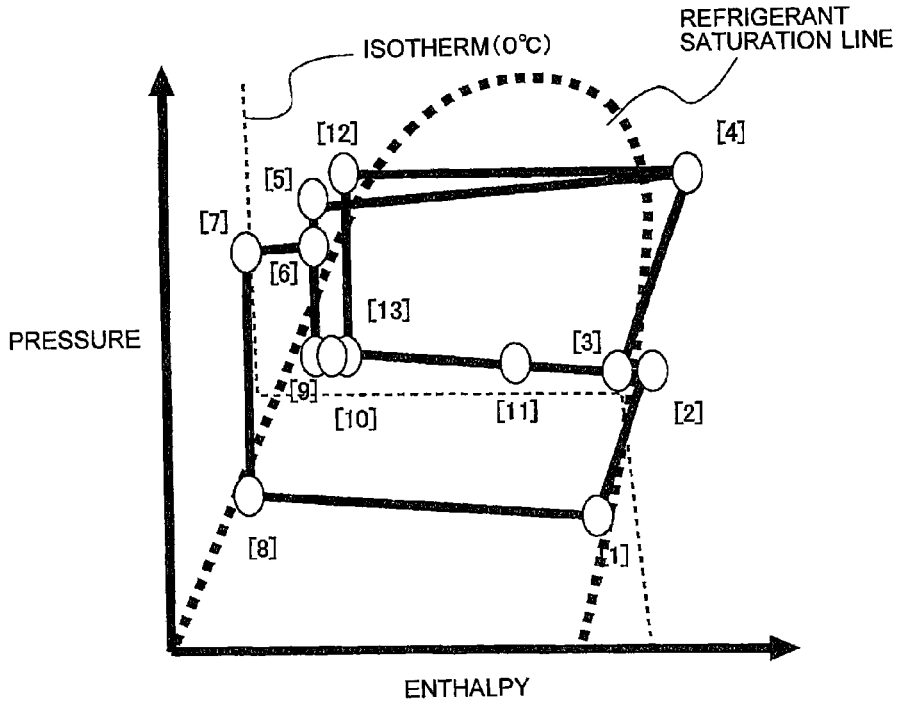
FIG. 9 illustrates a relationship between the pressure of the refrigerant and the enthalpy in the heating and defrosting simultaneous operation in a heat pump according to Embodiment 1 of the present invention.

Next, the description is provided with reference to FIGS. 2 to 4, which illustrate flows of the refrigerant in the apparatus and FIGS. 7 to 9, which are p-h diagrams (diagrams each illustrating a relationship between the pressure of the refrigerant and enthalpy). In FIGS. 2 to 4, the thick solid lines indicate flows of the refrigerant in operation, and the numbers in brackets, [i] (i=1, 2, . . . ), indicate pipe portions corresponding to points i (states of the refrigerant) in the diagrams of FIGS. 7 to 9.

FIG. 2 illustrates a flow occurring when cooling is performed by cooling the air inside a room using each of the indoor heat exchangers and transferring heat to the outside air using the outdoor heat exchangers (hereinafter referred to as cooling only operation).

FIG. 3 illustrates a flow occurring when heating is performed by heating the air in a room using each of the indoor heat exchangers and removing receiving heat from the outside air using the outdoor heat exchangers (hereinafter referred to as heating only operation).

FIG. 4 illustrates a flow occurring when a first one (outdoor heat exchanger 9*a* in FIG. 1) of parallel heat exchangers constituting the outdoor heat exchangers causes the refrigerant to evaporate and receives heat from the outside air and a second one (outdoor heat exchanger 9*b* in FIG. 1) of the parallel heat exchangers heats frost in the outdoor heat exchanger 9*b* to melt it (hereinafter referred to as heating and defrosting simultaneous operation). During the above heating operations, the indoor heat exchangers function as condensers, and the outdoor heat exchangers function as evaporators. The same applies to following Embodiment.

<Cooling Only Operation>

FIG. 2 illustrates a refrigerant flow in a cooling only operation in the air-conditioning apparatus according to Embodiment 1 of the present invention. FIG. 7 illustrates a relationship between the pressure of the refrigerant and the enthalpy in the cooling only operation of the air-conditioning apparatus according to Embodiment 1 of the present invention. The flow in the cooling only operation is described below with reference to FIGS. 2 and 7.

In the cooling only operation, the four-way valve 3 is switched to the state indicated by the broken lines in FIG. 2. The second flow switching device B is switched such that the refrigerant exiting the four-way valve 3 is split into both the outdoor heat exchangers 9*a* and 9*b* and the refrigerant exiting each of the outdoor heat exchangers 9*a* and 9*b* flows through the main pipe and is supplied to the refrigerant heat exchanger 6 and the indoor units 200*a* and 200*b*.

First, a low-temperature and low-pressure gas refrigerant is compressed by the injection compressor 1. Changes in the refrigerant in the injection compressor 1 are represented by an oblique line where the enthalpy slightly increases (points [1]-[2]) in consideration of the efficiency of the injection compressor 1.

Then, the refrigerant undergoing compression and the refrigerant flowing from the third bypass pipe 41 join together. Changes in the refrigerant in the joining are made under the state where the pressure is substantially constant and are represented by a horizontal line (points [2]-[3], points [9]-[3]). The refrigerant is further compressed and is discharged as the high-temperature and high-pressure gas refrigerant.

Changes in the refrigerant in the injection compressor 1 are represented by an oblique line where the enthalpy slightly increases (points [3]-[4]) in consideration of the efficiency of the injection compressor 1.

The high-temperature and high-pressure gas refrigerant discharged from the injection compressor 1 passes through the four-way valve 3 and is split, and then the split refrigerants pass through the second flow switching device B. The refrigerants enter the outdoor heat exchangers 9*a* and 9*b*, exchange heat with the outside air outside a room, condense and liquefy, and transfer heat to outside the room. Changes in the refrigerant in the outdoor heat exchangers 9*a* and 9*b* are made under the state where the pressure is substantially constant and are represented by a slightly oblique nearly horizontal line (point [4]→point [5]) in the p-h diagram in consideration of the pressure losses in the outdoor heat exchangers 9*a* and 9*b*.

The liquid refrigerants pass through the first flow switching device A and then join together. The joined refrigerant flows in the main pipe and is cooled in the refrigerant heat exchanger 6 by the refrigerant flowing in the third bypass pipe 41, and its temperature decreases. Changes in the refrigerant in the refrigerant heat exchanger 6 are made under the state where the pressure is substantially constant and are represented by a slightly oblique nearly horizontal line (point [5]→point [6]) in the p-h diagram in consideration of the pressure loss in the refrigerant heat exchanger 6.

The refrigerant exiting the refrigerant heat exchanger 6 partially enters the third bypass pipe 41, and the remaining thereof enters the indoor units 200*a* and 200*b*. The refrigerant entering the indoor units 200*a* and 200*b* is split, and the refrigerants enter the first flow control valves 5*a* and 5*b*, respectively. The refrigerants are decompressed into a low-pressure two-phase gas-liquid state. Changes in the refrigerant in the first flow control valves 5*a* and 5*b* are made under the state where the enthalpy is constant and are represented by a vertical line (point [6]→point [7]) in the p-h diagram.

The refrigerants decompressed to low pressure enter the indoor heat exchangers 4*a* and 4*b*, respectively. Each of the refrigerants exchanges heat with the air inside a room, evaporates, and cools the inside of the room. Changes in the refrigerant in the indoor heat exchangers 4*a* and 4*b* are made under the state where the pressure is substantially constant and are represented by a slightly oblique nearly horizontal line (point [7]→point [1]) in the p-h diagram in consideration of the pressure losses in the indoor heat exchangers 4*a* and 4*b*.

The low-temperature and low-pressure gas refrigerants exiting the indoor heat exchangers 4*a* and 4*b* join together. The joined refrigerant exits the indoor units 200*a* and 200*b*, enters the outdoor unit 100 through the main pipe, passes through the four-way valve 3 again, and is sucked into the injection compressor 1. The cooling operation is performed by circulation of the refrigerant through the main circuit in the above-described way.

The refrigerant entering the third bypass pipe 41 is decompressed by the fourth flow control valve 42 and changes into a low-temperature two-phase gas-liquid state. Changes in the refrigerant in the fourth flow control valve 42 are made under the state where the enthalpy is constant and are represented by a vertical line (point [6]→point [8]) in the p-h diagram.

The refrigerant entering the refrigerant heat exchanger 6 is heated by the refrigerant flowing in the main pipe and evaporates. Changes in the refrigerant in the refrigerant heat exchanger 6 are made under the state where the pressure is substantially constant and are represented by a slightly oblique nearly horizontal line (point [8]→point [9]) in the p-h diagram in consideration of the pressure loss in the refrigerant heat exchanger 6.

<Heating Only Operation>

FIG. 3 illustrates a refrigerant flow in a heating only operation in the air-conditioning apparatus according to Embodiment 1 of the present invention. FIG. 8 illustrates a relationship between the pressure of the refrigerant and the enthalpy in the heating only operation in the air-conditioning apparatus according to Embodiment 1 of the present invention. The flow in the heating only operation is described below with reference to FIGS. 3 and 8.

In the heating only operation, the four-way valve 3 is switched to the state indicated by the solid lines in FIG. 3. The first flow switching device A and the second flow switching device B are switched such that the refrigerant entering the outdoor unit 100 from the indoor units 200*a* and 200*b* is split, the split refrigerants are sent to both the outdoor heat exchangers 9*a* and 9*b* and join together, and the joined refrigerant passes through the four-way valve 3 and is sucked into the injection compressor 1.

First, a low-temperature and low-pressure gas refrigerant is compressed by the injection compressor 1. Changes in the refrigerant in the injection compressor 1 are represented by an oblique line where the enthalpy slightly increases (points [1]-[2]) in consideration of the efficiency of the injection compressor 1.

Then, the refrigerant undergoing compression and the refrigerant flowing from the third bypass pipe 41 join together. Changes in the refrigerant in the joining are made under the state where the pressure is substantially constant and are represented by a horizontal line (points [2]-[3], points [10]-[3]). The refrigerant is further compressed and is discharged as the high-temperature and high-pressure gas refrigerant.

Changes in the refrigerant in the injection compressor 1 are represented by an oblique line where the enthalpy slightly increases (points [3]-[4]) in consideration of the efficiency of the injection compressor 1. The high-temperature and high-pressure gas refrigerant discharged from the injection compressor 1 passes through the four-way valve 3 and is split. The split refrigerants enter the indoor units 200*a* and 200*b* through the main pipe, and each of the refrigerants exchanges heat with the air inside a room, condenses and liquefies, and heats on the inside of the room.

Changes in the refrigerant in the indoor heat exchangers 4*a* and 4*b* are made under the state where the pressure is substantially constant and are represented by a slightly oblique nearly horizontal line (point [4]→point [5]) in the p-h diagram in consideration of the pressure losses in the indoor heat exchangers 4*a* and 4*b*.

The liquid refrigerants are decompressed by the first flow control valves 5*a* and 5*b*. Changes in the refrigerant in the first flow control valves 5*a* and 5*b* are made under the state where the enthalpy is constant and are represented by a vertical line (point [5]→point [6]) in the p-h diagram.

The decompressed refrigerants join together. The joined refrigerant flows through the main pipe and partially enters the third bypass pipe 41, and the remaining thereof enters the refrigerant heat exchanger 6. The refrigerant entering the refrigerant heat exchanger 6 is cooled by the refrigerant flowing in the third bypass pipe 41, and its temperature decreases. Changes in the refrigerant in the refrigerant heat exchanger 6 are made under the state where the pressure is substantially constant and are represented by a slightly oblique nearly horizontal line (point [6]→point [7]) in the p-h diagram in consideration of the pressure loss in the refrigerant heat exchanger 6.

The refrigerant exiting the refrigerant heat exchanger 6 enters the second flow control valve 7 and is decompressed into a low-pressure two-phase gas-liquid state. Changes in the refrigerant in the second flow control valve 7 are made under the state where the enthalpy is constant and are represented by a vertical line (point [7]→point [8]) in the p-h diagram.

The refrigerant decompressed to low pressure is split, and the split refrigerants enter the outdoor heat exchangers 9*a* and 9*b*, exchange heat with the outside air outside a room, evaporate, and transfer heat to outside the room. Changes in the refrigerant in the outdoor heat exchangers 9*a* and 9*b* are made under the state where the pressure is substantially constant and are represented by a slightly oblique nearly horizontal line (point [8]→point [1]) in the p-h diagram in consideration of the pressure losses in the outdoor heat exchangers 9*a* and 9*b*. The low-temperature and low-pressure gas refrigerants exiting the outdoor heat exchangers 9*a* and 9*b* join together, and the joined refrigerant passes through the four-way valve 3 again and is sucked into the injection compressor 1. The heating operation is performed by circulation of the refrigerant through the main circuit in the above-described way.

The refrigerant entering the third bypass pipe 41 is decompressed by the fourth flow control valve 42 and changes into a low-temperature two-phase gas-liquid state. Changes in the refrigerant in the fourth flow control valve 42 are made under the state where the enthalpy is constant and are represented by a vertical line (point [5]→point [9]) in the p-h diagram.

The refrigerant entering the refrigerant heat exchanger 6 is heated by the refrigerant flowing in the main pipe and evaporates. Changes in the refrigerant in the refrigerant heat exchanger 6 are made under the state where the pressure is substantially constant and are represented by a slightly oblique nearly horizontal line (point [9]→point [10]) in the p-h diagram in consideration of the pressure loss in the refrigerant heat exchanger 6. In that operation, when the temperature of the air outside the room is low, frost occurs in the outdoor heat exchangers 9*a* and 9*b*, continuous operation increases the frost, and the amount of heat exchanged decreases.

<Heating and Defrosting Simultaneous Operation>

Next, the flow in a heating and defrosting simultaneous operation (in a heating operation at which the outdoor heat exchanger 9*b* is targeting for defrosting) is described with reference to FIGS. 4 and 9. In the heating and defrosting simultaneous operation, the four-way valve 3 is switched to the state indicated by the solid lines in FIG. 4, as in the state in the heating only operation.

The first flow switching device A is switched such that the refrigerant flowing from the indoor units 200*a* and 200*b* into the outdoor unit 100 is sent to only the outdoor heat exchanger 9*a*, passes through the four-way valve 3, and is sucked into the injection compressor 1.

It is switched such that the refrigerant discharged from the injection compressor 1 partially flows through the first bypass pipe 21, passes through the first flow switching device A, enters the outdoor heat exchanger 9*b*, flows through the second bypass pipe 31, and joins with the refrigerant flowing in the third bypass pipe 41.

First, the low-temperature and low-pressure gas refrigerant is compressed by the injection compressor 1. Changes in the refrigerant in the injection compressor 1 are represented by an oblique line where the enthalpy slightly increases (points [1]-[2]) in consideration of the efficiency of the injection compressor 1.

Then, the refrigerant undergoing compression and the refrigerant flowing from the third bypass pipe 41 join together. Changes in the refrigerant in the joining are made under the state where the pressure is substantially constant and are represented by a horizontal line (points [2]-[3], points [11]-[3]).

The refrigerant is further compressed and is discharged as the high-temperature and high-pressure gas refrigerant. Changes in the refrigerant in the injection compressor 1 are represented by an oblique line where the enthalpy slightly increases (points [3]-[4]) in consideration of the efficiency of the injection compressor 1.

The high-temperature and high-pressure refrigerant discharged from the injection compressor 1 partially enters the first bypass pipe 21. The remaining thereof passes through the four-way valve 3, flows through the main pipe, enters each of the indoor units 200*a* and 200*b*, exchanges heat with the air inside a room, condenses and liquefies, and heats the inside of the room. Changes in the refrigerant in the indoor heat exchangers 4*a* and 4*b* are made under the state where the pressure is substantially constant and are represented by a slightly oblique nearly horizontal line (point [4]→point [5]) in the p-h diagram in consideration of the pressure losses in the indoor heat exchangers 4*a* and 4*b*.

Then, the liquid refrigerants pass through the first flow control valves 5*a* and 5*b* and are decompressed. Changes in the refrigerant in the first flow control valves 5*a* and 5*b* are made under the state where the enthalpy is constant and are represented by a vertical line (point [5]→point [6]) in the p-h diagram. The decompressed refrigerants join together, and the joined refrigerant flows through the main pipe and partially enters the third bypass pipe 41. The remaining thereof enters the refrigerant heat exchanger 6.

The refrigerant entering the refrigerant heat exchanger 6 is cooled by the refrigerant flowing through the third bypass pipe 41, and its temperature decreases. Changes in the refrigerant in the refrigerant heat exchanger 6 are made under the state where the pressure is substantially constant and are represented by a slightly oblique nearly horizontal line (point [6]→point [7]) in the p-h diagram in consideration of the pressure loss in the refrigerant heat exchanger 6.

The refrigerant exiting the refrigerant heat exchanger 6 enters the second flow control valve 7 and is decompressed into a low-pressure two-phase gas-liquid state. Changes in the refrigerant in the second flow control valve 7 are made under the state where the enthalpy is constant and are represented by a vertical line (point [7]→point [8]) in the p-h diagram.

The refrigerant decompressed to low pressure passes through the first flow switching device A, enters the outdoor heat exchanger 9*a*, exchanges heat with the outside air outside a room, evaporates, and transfers heat to outside the room. Changes in the refrigerant in the outdoor heat exchanger 9*a* are made under the state where the pressure is substantially constant and are represented by a slightly oblique nearly horizontal line (point [8]→point [1]) in the p-h diagram in consideration of the pressure loss in the outdoor heat exchanger 9*a*. The low-temperature and low-pressure gas refrigerant exiting the outdoor heat exchanger 9*a* passes through the four-way valve 3 again and is sucked into the injection compressor 1. The heating operation is performed by circulation of the refrigerant through the main circuit in the above-described way.

The refrigerant entering the third bypass pipe 41 is decompressed by the fourth flow control valve 42 and changes into a low-temperature two-phase gas-liquid state. Changes in the refrigerant in the fourth flow control valve 42 are made under the state where the enthalpy is constant and are represented by a vertical line (point [6]→point [9]) in the p-h diagram.

Then, the refrigerant passing through the fourth flow control valve 42 joins with the refrigerant flowing from the second bypass pipe 31. Changes in the refrigerant in the joining are made under the state where the pressure is substantially constant and are represented by a horizontal line (point [9]-point [10], point [13]-point [10]) in the p-h diagram.

The joined refrigerant enters the refrigerant heat exchanger 6, is heated by the refrigerant flowing in the main pipe, and evaporates. Changes in the refrigerant in the refrigerant heat exchanger 6 are made under the state where the pressure is substantially constant and are represented by a slightly oblique nearly horizontal line (point [10]→point [11]) in the p-h diagram in consideration of the pressure loss in the refrigerant heat exchanger.

The refrigerant entering the first bypass pipe 21 passes through the first flow switching device A and condenses while melting frost occurring in the outdoor heat exchanger 9*b*. Changes in the refrigerant in the outdoor heat exchanger 9*b* are made under the state where the pressure is substantially constant and are represented by a slightly oblique nearly horizontal line (point [4]→point [12]) in the p-h diagram in consideration of the pressure loss in the outdoor heat exchanger 9*b*.

The condensed refrigerant is decompressed by the third flow control valve 32*b* and changes into the two-phase gas-liquid refrigerant. Changes in the refrigerant in the third flow control valve 32*b* are made under the state where the enthalpy is constant and are represented by a vertical line (point [12]→point [13]) in the p-h diagram.

The decompressed refrigerant flows through the second bypass pipe 31 and joins with the refrigerant flowing in the third bypass pipe 41.

In the above-described way, in this operation mode, frost in the outdoor heat exchanger 9*b* can be melted while the inside of a room is heated. In the heating operation at which the outdoor heat exchanger 9*a* is targeting for defrosting, the first flow switching device A and the second flow switching device B are switched, and an operation of melting frost in the outdoor heat exchanger 9*a* and of transferring heat to outside the room in the outdoor heat exchanger 9*b* is performed.

<Method of Adjusting Discharge Temperature of Refrigerant from Injection Compressor 1>

Next, a method of adjusting the discharge temperature of the refrigerant from the injection compressor 1 is described. When the discharge temperature of the refrigerant from the injection compressor 1 measured by the temperature sensor 2 is equal to or higher than an upper limit temperature for securing reliability of the injection compressor 1, the opening degree of the fourth flow control valve 42 is increased. When that temperature is lower than the upper limit, the opening degree of the fourth flow control valve 42 is reduced.

In the heating operation at a low outside temperature, because the discharge temperature of the refrigerant from the injection compressor 1 increases, monitoring the discharge temperature of the refrigerant from the injection compressor 1 prevents abnormal increase in the discharge temperature of the refrigerant exiting the injection compressor 1.

As described above, the air-conditioning apparatus 1000 according to Embodiment 1 is operable in three modes of the cooling only operation, the heating only operation, and the heating and defrosting simultaneous operation and can continuously heat the inside of a room by the heating and defrosting simultaneous operation if frost occurs in the outdoor heat exchanger 9*b* and the performance starts decreasing because of a decrease in the volume of air or a decrease in the evaporating temperature.

In the air-conditioning apparatus 1000 according to Embodiment 1, the refrigerant for defrosting is injected not into the suction side but in the course of a compression process in the injection compressor 1. Thus, it is not necessary to lower the pressure of the refrigerant for defrosting to a suction pressure. Accordingly, the injection compressor 1 needs to raise only the pressure of the refrigerant circulating through the main circuit from low to high, and needs to raise the pressure of the injected intermediate-pressure two-phase gas-liquid refrigerant only from intermediate to high. Consequently, the workload of the injection compressor 1 is reduced, and the efficiency of the heat pump (heating capacity/workload of the injection compressor 1) is improved. That also contributes to energy saving.

In the air-conditioning apparatus 1000 according to Embodiment 1, the two-phase gas-liquid refrigerant entering the injection compressor 1 through the injection port is heated by the intermediate-pressure gas refrigerant undergoing compression and changes into the gas state inside the injection compressor 1. Thus, the reliability of the heat pump is improved. In Embodiment 1 described above, the difference of enthalpies of the refrigerant used in defrosting (length of the segment from point [4] to point [12] in FIG. 9) can be larger than that in a conventional air-conditioning apparatus (length of the segment from point [6] to point [7] in FIG. 8), and defrosting can be performed with a low flow rate of the refrigerant and thus heating capacity is improved.

In addition, the air-conditioning apparatus 1000 according to Embodiment 1 includes the temperature sensor 2 for measuring the discharge temperature of the refrigerant from the injection compressor 1 and controls the fourth flow control valve 42 in accordance with the discharge temperature. Accordingly, an increase in the discharge temperature under a low outside air temperature condition can be suppressed, and the reliability of the injection compressor 1 is enhanced.

Additionally, in the heating operation in the air-conditioning apparatus 1000 according to Embodiment 1, the outdoor heat exchanger 9*b* targeting for defrosting exchanges heat while the refrigerant flows in a direction parallel to the direction in which the outside air flows, whereas the outdoor heat exchanger 9*a* not targeting for defrosting exchanges heat while the refrigerant flows in a direction opposite to the direction of the outside air flows. The flow of the refrigerant in the heating and defrosting simultaneous operation is described below with reference to FIG. 6.

Figure 6:
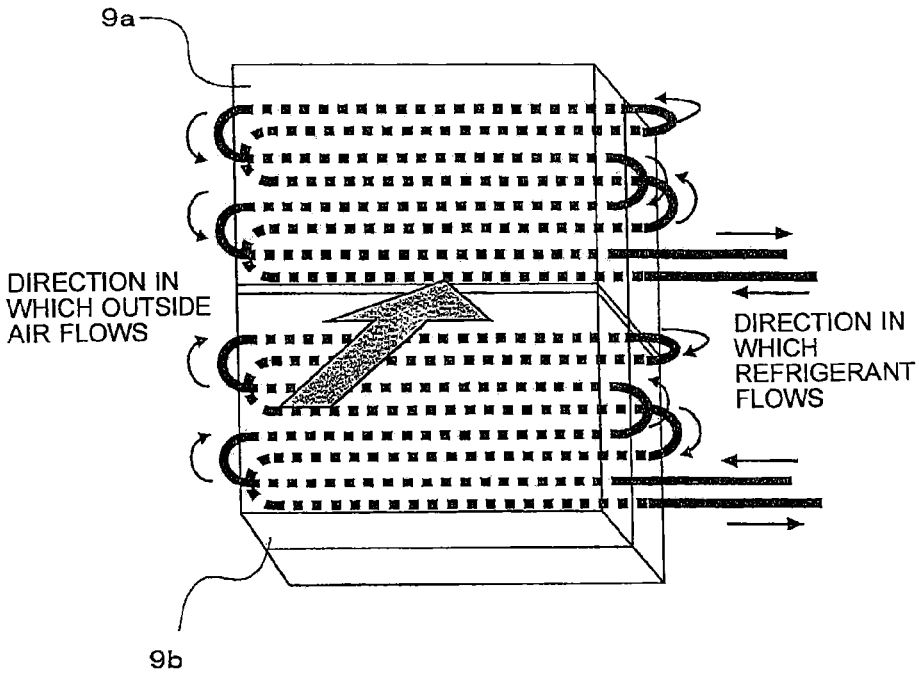
FIG. 6 illustrates a configuration of outdoor heat exchangers included in the air-conditioning apparatus and a refrigerant flow according to Embodiment 1 of the present invention.

The outdoor heat exchangers 9*a* and 9*b* illustrated in FIG. 6 are fin-tube heat exchangers in which a plurality of heat transfer tubes extend through a plurality of fins along a direction perpendicular to the plurality of fins and are configured such that two rows of the heat exchangers are arranged in the air flow direction, and the two rows are horizontally divided into two parts. In the outdoor heat exchanger 9*a*, a low-temperature and low-pressure two-phase gas-liquid refrigerant flows from the downstream row with respect to the air flow direction, evaporates while transferring heat to the air, moves to the upstream row, further evaporates, and flows out of the outdoor heat exchanger 9*a*. In contrast, in the outdoor heat exchanger 9*b*, which is performing defrosting, a high-temperature and high-pressure refrigerant flows from the row upstream in the air flow, condenses while heating and melting frost, moves to the downstream row, further condenses, and flows out of the outdoor heat exchanger 9*b*. In the outdoor heat exchanger 9*a*, which is not targeting for defrosting, the difference between the temperature of the air and that of the refrigerant can be large, operation can be efficient. In the outdoor heat exchanger 9*b*, which is targeting for defrosting, a higher-temperature refrigerant can be supplied to the upstream side in the air flow direction on which the amount of frost is largest, and the frost can be melted efficiently.

Two-way valves each capable of being opened and closed independently of the magnitude of the pressure at each of the inlet and outlet of the valve and capable of stopping a refrigerant in only one direction are used in the air-conditioning apparatus 1000 according to Embodiment 1. Accordingly, two-way valves each having a simple internal structure capable of stopping the refrigerant in only one direction can be used.

The air-conditioning apparatus 1000 according to Embodiment 1 includes the first flow switching device A and the second flow switching device B for each of the plurality of outdoor heat exchangers 9*a* and 9*b* such that the direction of the refrigerant flowing from each of the outdoor heat exchangers 9*a* and 9*b* to the main pipe coincides with the direction in which the two-way valve can stop the refrigerant. In all of the operation modes, the refrigerant in the first flow switching device A and the second flow switching device B can be stopped without leakage.

The air-conditioning apparatus 1000 according to Embodiment 1 is described as the configuration in which the second bypass pipe 31 is provided with the third flow control valves 32*a* and 32*b*. The configuration may be used in which each of the two pipes into which the second bypass pipe 31 is split is provided with two two-way valves and the single pipe after joining is provided with one flow control valve. With that configuration, the temperature of the refrigerant entering the outdoor heat exchanger 9*b* targeting for defrosting can decrease and a change in the refrigerant inside the outdoor heat exchanger 9*b* targeting for defrosting can be reduced, unevenness of deicing can be reduced, and thus the efficiency of deicing can be enhanced.

The air-conditioning apparatus 1000 according to Embodiment 1 includes the third bypass pipe 41 having the first end connected between the outdoor heat exchangers 9*a* and 9*b* and the first flow control valve 5 and the second end connected to the injection port of the injection compressor 1, the refrigerant heat exchanger 6 for exchanging heat between the refrigerant flowing between the first flow control valve 5 and the outdoor heat exchangers 9*a* and 9*b* and the refrigerant flowing in the third bypass pipe 41, and the fourth flow control valve 42 for controlling the flow rate of the refrigerant flowing through the third bypass pipe 41. The first end of the second bypass pipe 31 is connected to the third bypass pipe 41 ahead of the refrigerant heat exchanger 6. Thus the refrigerant exiting the outdoor heat exchanger 9*b* targeting for defrosting and the refrigerant flowing in the main pipe can exchange heat with each other in the refrigerant heat exchanger 6, and the efficiency can be enhanced.

The order of defrosting in the heating and defrosting simultaneous operation is not described in the air-conditioning apparatus 1000 according to Embodiment 1. In the case of the heat exchanger illustrated in FIG. 6, the outdoor heat exchanger 9*b* may be defrosted after the upper outdoor heat exchanger 9*a* is defrosted. With that configuration, even if water after deicing in the upper outdoor heat exchanger (outdoor heat exchanger 9*a* in FIG. 6) freezes in the lower outdoor heat exchanger (outdoor heat exchanger 9*b* in FIG. 6) again, the frost can be fully removed by the defrosting operation, and the reliability of the air-conditioning apparatus can be enhanced.

Embodiment 2

Figure 10:
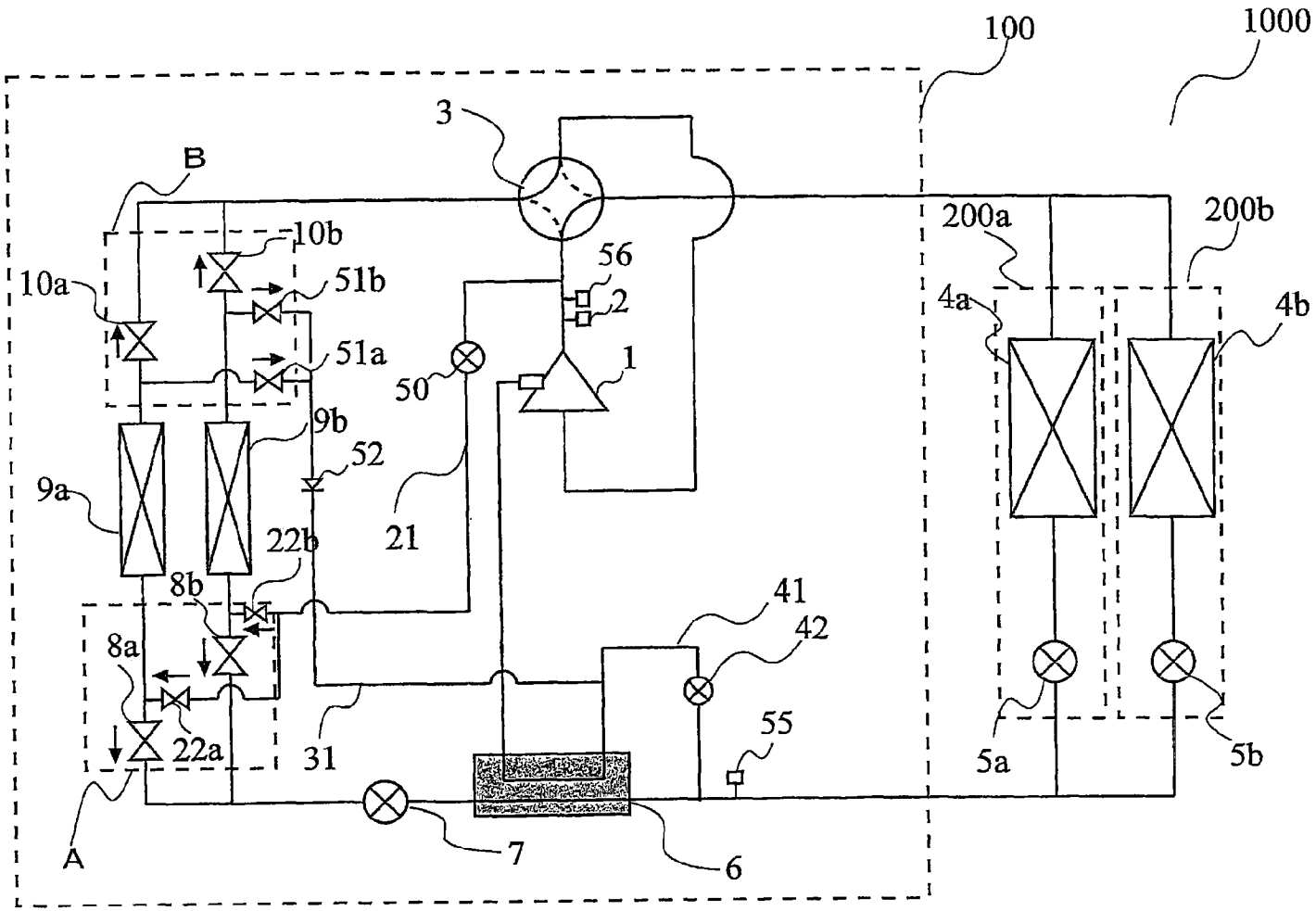
FIG. 10 illustrates a refrigerant circuit in an air-conditioning apparatus according to Embodiment 2 of the present invention.
Figure 11:
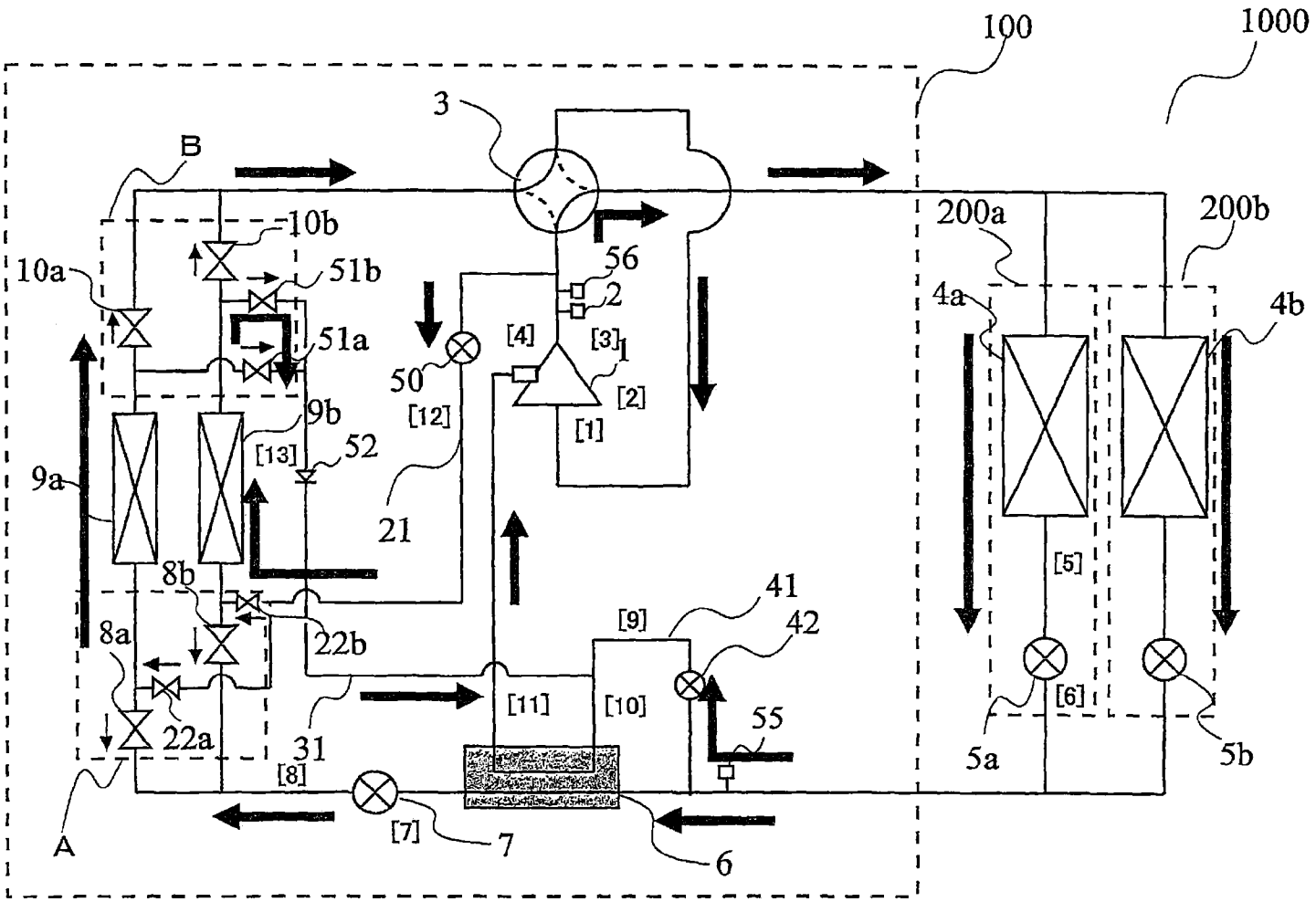
FIG. 11 illustrates a refrigerant flow in a heating and defrosting simultaneous operation in the air-conditioning apparatus according to Embodiment 2 of the present invention.
Figure 12:
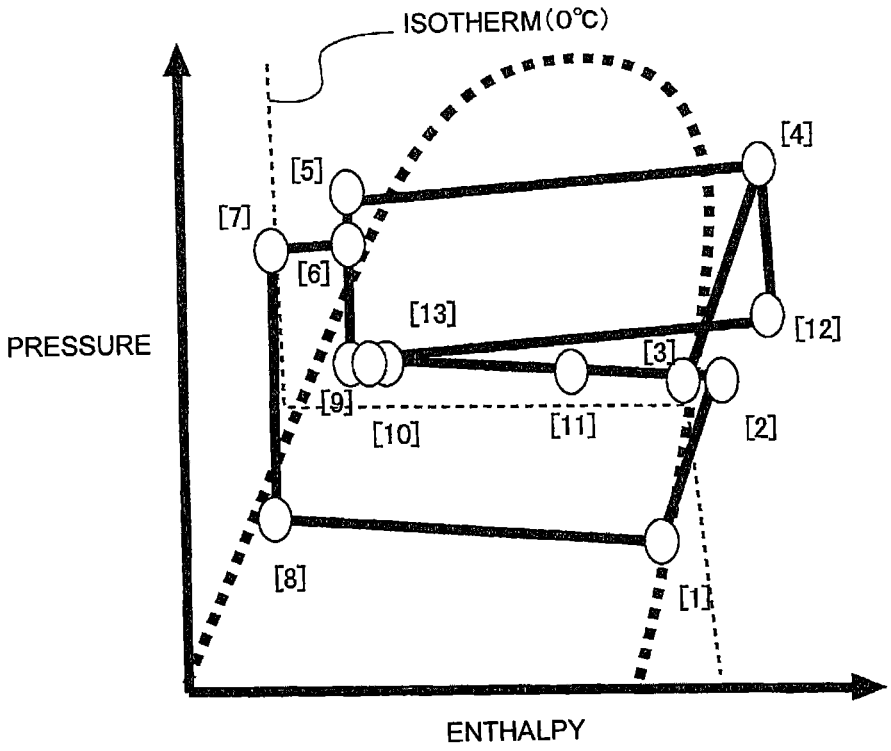
FIG. 12 illustrates a relationship between the pressure of the refrigerant and the enthalpy in the heating and defrosting simultaneous operation in a heat pump according to Embodiment 2 of the present invention.

Embodiment 2 of the present invention is described below with reference to FIGS. 10 to 12. The same reference numerals are used in the same parts. FIG. 10 illustrates a refrigerant circuit in an air-conditioning apparatus according to Embodiment 2 of the present invention. FIG. 11 illustrates a refrigerant flow in the heating and defrosting simultaneous operation in the air-conditioning apparatus according to Embodiment 2 of the present invention. FIG. 12 illustrates a relationship between the pressure of the refrigerant and the enthalpy in the heating and defrosting simultaneous operation of a heat pump according to Embodiment 2 of the present invention. The air-conditioning apparatus 1000 is described below with reference to FIG. 10.

The air-conditioning apparatus 1000 includes the outdoor unit 100, the indoor units 200*a* and 200*b*, and the main pipe connecting them such that a refrigerant circulates therethrough. The air-conditioning apparatus 1000 is a multi-type air-conditioning apparatus in which two indoor units are connected to one outdoor unit.

The outdoor unit 100 includes two-way valves 51*a* and 51*b* connected to the second bypass pipe 31 and a fifth flow control valve 50 (corresponding to a first bypass flow control valve in the present invention) disposed on the first bypass pipe 21. The outdoor unit 100 further includes a second pressure sensor 56 on the discharge side of the injection compressor 1 and a first pressure sensor 55 between the refrigerant heat exchanger 6 and the first flow control valves 5*a* and 5*b* (between the branch point to the third bypass pipe 41 and the first flow control valves 5*a* and 5*b*).

Each of the two-way valves 22*a*, 22*b*, 51*a*, and 51*b* is configured as a valve substantially the same as in Embodiment 1 illustrated in FIG. 5 or an electromagnetic valve openable and closable by a motor.

In Embodiment 2, each of the two-way valves 8*a*, 8*b*, 10*a*, 10*b*, 22*a*, 22*b*, 51*a*, and 51*b* can stop a refrigerant in only the direction indicated by the arrow in FIGS. 10 and 11, as in Embodiment 1.

A check valve 52 is disposed between the portion where the two-way valves 51*a* and 51*b* are disposed and the portion where the second bypass pipe 31 and the third bypass pipe 41 are connected. The check valve 52 is used to prevent a refrigerant from flowing from the portion where the second bypass pipe 31 and the third bypass pipe 41 are connected toward the direction of the two-way valves 51*a* and 51*b*. The second pressure sensor 56 measures the discharge pressure of the refrigerant from the injection compressor 1. The first pressure sensor 55 measures the pressure at a location between the refrigerant heat exchanger 6 and the first flow control valves 5*a* and 5*b* (between the branch point to the third bypass pipe 41 and the first flow control valves 5*a* and 5*b*).

The other configuration is substantially the same as in Embodiment 1, and the description thereof is omitted here.

Next, the description is provided with reference to FIG. 11, which illustrates a refrigerant flow in the above-described apparatus, and FIG. 12, which is a p-h diagram (diagram illustrating a relationship between the pressure of the refrigerant and the enthalpy). In FIG. 11, the thick solid lines indicate flows of the refrigerant in operation, and the numbers in brackets, [i] (i=1, 2, . . . ), indicate pipe portions corresponding to points i (states of the refrigerant) in the diagram of FIG. 12.

FIG. 11 illustrates a flow occurring when the air inside a room is heated by each of the indoor heat exchangers 4*a* and 4*b*, a first one (outdoor heat exchanger 9*a* in FIG. 11) of parallel heat exchangers constituting the outdoor heat exchangers causes the refrigerant to evaporate and receives heat from the outside air and a second one (outdoor heat exchanger 9*b* in FIG. 11) of the parallel heat exchangers heats frost in the outdoor heat exchanger 9*b* to melt it (hereinafter referred to as heating and defrosting simultaneous operation). During the heating operation, the indoor heat exchangers 4*a* and 4*b* function as condensers, and the outdoor heat exchangers 9*a* and 9*b* function as evaporators. The same applies to Embodiment below.

The other operation modes, the cooling operation and the heating operation, are substantially the same as in Embodiment 1, and the description thereof is omitted here.

<Heating and Defrosting Simultaneous Operation>

Next, a flow in a heating and defrosting simultaneous operation (in the heating operation at which the outdoor heat exchanger 9*b* is targeting for defrosting) is described with reference to FIGS. 11 and 12. In the heating and defrosting simultaneous operation, the four-way valve 3 is switched to the state indicated by the solid lines in FIG. 11, as in the state in the heating only operation.

The first flow switching device A is switched such that the refrigerant entering the outdoor unit 100 from the indoor units 200*a* and 200*b* is sent to only the outdoor heat exchanger 9*a*, passes through the four-way valve 3, and is sucked into the injection compressor 1.

It is switched such that the refrigerant discharged from the injection compressor 1 partially flows through the first bypass pipe 21, passes through the first flow switching device A, enters the outdoor heat exchanger 9*b*, flows through the second bypass pipe 31, and joins with the refrigerant flowing in the third bypass pipe 41.

First, a low-temperature and low-pressure gas refrigerant is compressed by the injection compressor 1. Changes in the refrigerant in the injection compressor 1 are represented by an oblique line where the enthalpy slightly increases (points [1]-[2]) in consideration of the efficiency of the injection compressor 1.

Then, the refrigerant undergoing compression and the refrigerant flowing from the third bypass pipe 41 join together. Changes in the refrigerant in the joining are made under the state where the pressure is substantially constant and are represented by a horizontal line (points [2]-[3], points [11]-[3]).

The refrigerant is further compressed and is discharged as the high-temperature and high-pressure gas refrigerant. Changes in the refrigerant in the injection compressor 1 are represented by an oblique line where the enthalpy slightly increases (points [3]-[4]) in consideration of the efficiency of the injection compressor 1.

The high-temperature and high-pressure refrigerant discharged from the injection compressor 1 partially enters the first bypass pipe 21, and the remaining thereof passes through the four-way valve 3, flows through the main pipe, enters each of the indoor units 200*a* and 200*b*, exchanges heat with the air inside a room, condenses and liquefies, and heats the inside of the room. Changes in the refrigerant in the indoor heat exchangers 4*a* and 4*b* are made under the state where the pressure is substantially constant and are represented by a slightly oblique nearly horizontal line (point [4]→point [5]) in the p-h diagram in consideration of the pressure losses in the indoor heat exchangers 4*a* and 4*b*.

Then, the liquid refrigerants pass through the first flow control valves 5*a* and 5*b* and are decompressed. Changes in the refrigerant in the first flow control valves 5*a* and 5*b* are made under the state where the enthalpy is constant and are represented by a vertical line (point [5]→point [6]) in the p-h diagram. The decompressed refrigerants join together, and the joined refrigerant flows through the main pipe and partially enters the third bypass pipe 41. The remaining thereof enters the refrigerant heat exchanger 6.

The refrigerant entering the refrigerant heat exchanger 6 is cooled by the refrigerant flowing through the third bypass pipe 41, and its temperature decreases. Changes in the refrigerant in the refrigerant heat exchanger 6 are made under the state where the pressure is substantially constant and are represented by a slightly oblique nearly horizontal line (point [6]→point [7]) in the p-h diagram in consideration of the pressure loss in the refrigerant heat exchanger 6.

The refrigerant exiting the refrigerant heat exchanger 6 enters the second flow control valve 7 and is decompressed into a low-pressure two-phase gas-liquid state. Changes in the refrigerant in the second flow control valve 7 are made under the state where the enthalpy is constant and are represented by a vertical line (point [7]→point [8]) in the p-h diagram.

The refrigerant decompressed to low pressure, passes through the first flow switching device A, enters the outdoor heat exchanger 9*a*, exchanges heat with the outside air outside a room, evaporates, and transfers heat to outside the room. Changes in the refrigerant in the outdoor heat exchanger 9*a* are made under the state where the pressure is substantially constant and are represented by a slightly oblique nearly horizontal line (point [8]→point [1]) in the p-h diagram in consideration of the pressure loss in the outdoor heat exchanger 9*a*. The low-temperature and low-pressure gas refrigerant exiting the outdoor heat exchanger 9*a* passes through the four-way valve 3 again and is sucked into the injection compressor 1. The heating operation is performed by circulation of the refrigerant through the main circuit in the above-described way.

The refrigerant entering the third bypass pipe 41 is decompressed by the fourth flow control valve 42 and changes into a low-temperature two-phase gas-liquid state. Changes in the refrigerant in the fourth flow control valve 42 are made under the state where the enthalpy is constant and are represented by a vertical line (point [6]→point [9]) in the p-h diagram.

Then, the refrigerant passing through the fourth flow control valve 42 joins with the refrigerant flowing from the second bypass pipe 31. Changes in the refrigerant in the joining are made under the state where the pressure is substantially constant and are represented by a horizontal line (point [9]-point [10], point [13]-point [10]) in the p-h diagram.

The joined refrigerant enters the refrigerant heat exchanger 6, is heated by the refrigerant flowing in the main pipe, and evaporates. Changes in the refrigerant in the refrigerant heat exchanger 6 are made under the state where the pressure is substantially constant and are represented by a slightly oblique nearly horizontal line (point [10]→point [11]) in the p-h diagram in consideration of the pressure loss in the refrigerant heat exchanger.

The refrigerant entering the first bypass pipe 21 is decompressed by the fifth flow control valve 50. Changes in the refrigerant in the fifth flow control valve 50 are made under the state where the enthalpy is constant and are represented by a vertical line (point [4]→point [12]) in the p-h diagram. The decompressed refrigerant passes through the first flow switching device A and condenses while melting frost occurring in the outdoor heat exchanger 9*b*. Changes in the refrigerant in the outdoor heat exchanger 9*b* are made under the state where the pressure is substantially constant and are represented by a slightly oblique nearly horizontal line (point [12]→point [13]) in the p-h diagram in consideration of the pressure loss in the outdoor heat exchanger 9*b*.

The decompressed refrigerant flows through the second bypass pipe 31 and joins with the refrigerant flowing in the third bypass pipe 41.

In the above-described way, in this operation mode, frost in the outdoor heat exchanger 9*b* can be melted while the inside of a room is heated. In the heating operation at which the outdoor heat exchanger 9*a* is targeting for defrosting, the first flow switching device A and the second flow switching device B are switched, and an operation of melting frost in the outdoor heat exchanger 9*a* and of transferring heat to outside the room in the outdoor heat exchanger 9*b* is performed.

The method of adjusting the discharge temperature of the refrigerant from the injection compressor 1 is substantially the same as in Embodiment 1, and the description thereof is omitted here.

As described above, the air-conditioning apparatus 1000 according to Embodiment 2 can reduce the temperature of the refrigerant entering the outdoor heat exchanger 9*b* targeting for defrosting and changes in the temperature, can reduce unevenness of deicing, and can enhance the efficiency of deicing, in addition to achieving substantially the same advantageous effects as in Embodiment 1.

Additionally, the air-conditioning apparatus 1000 according to Embodiment 2 includes the second pressure sensor 56 for measuring the discharge temperature of the refrigerant from the injection compressor 1 and controls the fifth flow control valve 50 such that the refrigerant is at a predetermined discharge pressure in the heating and defrosting simultaneous operation, and thus heating capacity of each of the indoor heat exchangers 4*a* and 4*b* can be maintained. Specifically, when the discharge pressure is lower than the predetermined pressure, the opening degree of the fifth flow control valve 50 is reduced. When the discharge pressure is higher than the predetermined pressure, the opening degree of the fifth flow control valve 50 is increased.

In addition, the air-conditioning apparatus 1000 according to Embodiment 2 includes the first pressure sensor 55 for measuring the pressure at a location between the refrigerant heat exchanger 6 and the first flow control valves 5*a* and 5*b* (between the branch point to the third bypass pipe 41 and the first flow control valves 5*a* and 5*b*) and controls the second flow control valve 7 in accordance with the measured pressure. Thus, the pressure of the refrigerant entering the fourth flow control valve 42 and the refrigerant heat exchanger 6 can be controlled to a predetermined value, the amount of heat exchanged in each of the refrigerant heat exchanger 6 and the outdoor heat exchangers 9*a* and 9*b* can be controlled, and operation is stabilized. Specifically, when the pressure is lower than the predetermined pressure, the opening degree of the second flow control valve 7 is increased. When the pressure is higher than the predetermined pressure, the opening degree of the second flow control valve 7 is reduced.

REFERENCE SIGNS LIST

1 injection compressor 2 temperature sensor 3 four-way valve 4*a*, 4*b* indoor heat exchanger 5*a*, 5*b* first flow control valve 6 refrigerant heat exchanger 7 second flow control valve 8*a*, 8*b* two-way valve 9*a*, 9*b* outdoor heat exchanger 10*a*, 10*b* two-way valve 21 first bypass pipe 22*a*, 22*b* two-way valve 31 second bypass pipe 32*a*, 32*b* third flow control valve 41 third bypass pipe 42 fourth flow control valve 50 fifth flow control valve 51*a*, 51*b* two-way valve 52 check valve 55 first pressure sensor 56 second pressure sensor 100 outdoor unit 200*a*, 200*b* indoor unit 1000 air-conditioning apparatus A first flow switching device B second flow switching device M1, M2 main pipe P1, P2 pressure chamber S small slide valve T1, T2, T3, T4 pipe U valve seat V valve body W1, W2 movable wall X pressure adjusting device Y small slide valve driving device.

The invention claimed is:

1. An air-conditioning apparatus including a main pipe that connects at least one indoor unit and an outdoor unit such that a refrigerant circulates therethrough, the air-conditioning apparatus further comprising:

an indoor heat exchanger provided in the at least one indoor unit;

a first flow control valve configured to control a flow rate of the refrigerant entering the indoor heat exchanger;

an injection compressor including an injection port allowing part of the refrigerant circulating to be injected therethrough into the refrigerant undergoing compression;

a refrigerant flow switching device configured to switch between a cooling operation and a heating operation;

a plurality of outdoor heat exchangers provided in the outdoor unit and connected in parallel;

a first bypass pipe having a first end connected between the injection compressor and the refrigerant flow switching device and a second end connected to first ones of inlet and outlet sides of the plurality of outdoor heat exchangers;

a first bypass flow control valve provided to the first bypass pipe and configured to control a flow rate of the refrigerant;

a second bypass pipe having a first end connected to the injection port or a pipe connected to the injection port and a second end connected to second ones of the inlet and outlet sides of the plurality of outdoor heat exchangers;

a first flow switching device configured to switch a flow of the refrigerant to the main pipe or the first bypass pipe; and a second flow switching device configured to switch the flow of the refrigerant to the main pipe or the second bypass pipe, wherein in a defrosting operation of removing frost in any of the plurality of outdoor heat exchangers, the first flow switching device causes part of the refrigerant discharged from the injection compressor to flow through the first bypass pipe and decompress thereof by the first bypass flow control valve, and the refrigerant is supplied to an outdoor heat exchanger comprising the plurality of outdoor heat exchangers and targeting for defrosting, and the second flow switching device causes part of the refrigerant supplied to the outdoor heat exchanger targeting for defrosting to enter the second bypass pipe.

2. The air-conditioning apparatus of claim 1, wherein in the heating operation, the outdoor heat exchanger comprising the plurality of outdoor heat exchangers and targeting for defrosting exchanges heat while the refrigerant flows in a direction parallel to a direction in which outside air flows, and an outdoor heat exchanger comprising the plurality of outdoor heat exchangers and not targeting for defrosting exchanges heat while the refrigerant flows in a direction opposite to the direction in which the outside air flows.

3. The air-conditioning apparatus of claim 1, wherein each of the first flow switching device and the second flow switching device includes a two-way valve openable and closable independently of a magnitude of a pressure at each of an inlet and an outlet of the valve.

4. The air-conditioning apparatus of claim 3, wherein each of the first flow switching device and the second flow switching device is configured to stop the flow of the refrigerant in only one direction.

5. The air-conditioning apparatus of claim 4, wherein each of the first flow switching device and the second flow switching device is configured to stop the flow in a direction in which the refrigerant flows from the outdoor heat exchangers toward the main pipe.

6. The air-conditioning apparatus of claim 1, further comprising a second bypass flow control valve disposed on the second bypass pipe and configured to control the flow rate of the refrigerant.

7. The air-conditioning apparatus of claim 1, further comprising:

a third bypass pipe having a first end connected between the outdoor heat exchangers and the first flow control valve and a second end connected to the injection port;

a refrigerant heat exchanger configured to exchange heat between the refrigerant flowing between the outdoor heat exchangers and the first flow control valve and the refrigerant flowing in the third bypass pipe; and an injection flow control valve configured to control the flow rate of the refrigerant flowing in the third bypass pipe, wherein the first end of the second bypass pipe is connected to the third bypass pipe.

8. The air-conditioning apparatus of claim 7, wherein the first end of the second bypass pipe is connected to the third bypass pipe ahead of the refrigerant heat exchanger.

9. The air-conditioning apparatus of claim 7, further comprising:

a temperature sensor configured to measure a temperature of the refrigerant discharged from the injection compressor, wherein when a value measured by the temperature sensor is equal to or higher than a predetermined temperature, an opening degree of the injection flow control valve is increased, and when the value measured by the temperature sensor is lower than the predetermined temperature, the opening degree of the injection flow control valve is reduced.

10. The air-conditioning apparatus of claim 7, further comprising:

an outdoor flow control valve disposed between the refrigerant heat exchanger and the first flow switching device and configured to control the flow rate of the refrigerant; and a first pressure sensor configured to sense a pressure at a location between the first flow control valve and the refrigerant heat exchanger and between a branch point to the third bypass pipe and the first flow control valve, wherein an opening degree of the outdoor flow control valve is controlled on a basis of a value detected by the first pressure sensor.

11. The air-conditioning apparatus of claim 1, further comprising a second pressure sensor configured to sense a pressure of the refrigerant discharged from the injection compressor, wherein an opening degree of the first bypass flow control valve is controlled on a basis of a value detected by the second pressure sensor.

12. The air-conditioning apparatus of claim 1, wherein the plurality of outdoor heat exchangers are divided into upper and lower outdoor heat exchangers, after the defrosting operation is performed on the upper outdoor heat exchanger out of the divided outdoor heat exchangers, the defrosting operation is performed on the lower outdoor heat exchanger out of the divided outdoor heat exchangers.

13. The air-conditioning apparatus of claim 1, wherein the indoor heat exchanger and the first flow control valve are accommodated in each indoor unit, the injection compressor, the refrigerant flow switching device, the plurality of outdoor heat exchangers, the first bypass pipe, the second bypass pipe, the first flow switching device, and the second flow switching device are accommodated in the outdoor unit, and the outdoor unit is connected to the at least one indoor unit.

14. The air-conditioning apparatus of claim 1, wherein the refrigerant discharged from the injection compressor partially passes the first bypass pipe and the rest of the discharged refrigerant enters the indoor heat exchanger through the main pipe, thereby performing the defrosting operation and the heating operation simultaneously.

* * * * *